US010266785B2

(12) United States Patent
Dodd

(10) Patent No.: US 10,266,785 B2
(45) Date of Patent: Apr. 23, 2019

(54) GAS ENGINE LUBRICATING OIL COMPOSITION

(71) Applicant: Infineum International Limited, Abingdon (GB)

(72) Inventor: James C. Dodd, Didcot (GB)

(73) Assignee: INFINEUM INTERNATIONAL LIMITED (GB)

( * ) Notice: Subject to any disclaimer, the term of this patent is extended or adjusted under 35 U.S.C. 154(b) by 0 days.

(21) Appl. No.: 14/561,261

(22) Filed: Dec. 5, 2014

(65) Prior Publication Data

US 2015/0159107 A1 Jun. 11, 2015

(30) Foreign Application Priority Data

Dec. 5, 2013 (EP) ..... 13195913

(51) Int. Cl.

| | |
|---|---|
| ***C10L 1/22*** | (2006.01) |
| ***C10M 129/54*** | (2006.01) |
| ***C10M 141/06*** | (2006.01) |
| ***C10M 163/00*** | (2006.01) |

(52) U.S. Cl.

CPC ..... *C10M 141/06* (2013.01); *C10M 163/00* (2013.01); *C10M 2203/1025* (2013.01); *C10M 2207/026* (2013.01); *C10M 2207/262* (2013.01); *C10M 2215/064* (2013.01); *C10M 2215/28* (2013.01); *C10N 2210/02* (2013.01); *C10N 2220/021* (2013.01); *C10N 2230/06* (2013.01); *C10N 2230/12* (2013.01); *C10N 2230/44* (2013.01); *C10N 2230/45* (2013.01); *C10N 2230/52* (2013.01); *C10N 2240/103* (2013.01); *C10N 2240/104* (2013.01); *C10N 2260/14* (2013.01)

(58) Field of Classification Search

CPC ..... C10M 2207/262; C10M 139/06; C10M 159/22; C10M 2215/065

USPC ..... 508/192, 518

See application file for complete search history.

(56) References Cited

U.S. PATENT DOCUMENTS

2011/0245120 A1* 10/2011 Bertram ..... C10M 163/00 508/287

OTHER PUBLICATIONS

European Search Report dated Jun. 2, 2014 on EP Application No. 13195913.2 which is the European counterpart of the above-identified U.S. application.

* cited by examiner

*Primary Examiner* — Prem C Singh
*Assistant Examiner* — Francis C Campanell

(57) ABSTRACT

A gas engine lubricating oil composition comprises an oil of lubricating viscosity including at least 90 mass % saturates and no more than 0.03 mass % to sulfur, a metal hydroxybenzoate detergent additive, a dispersant additive, and an aminic or phenolic antioxidant additive, and has a boron concentration, of zero or less than 90 ppm by mass, where boron, if present, is provided at least in part by a boron-containing dispersant additive. The composition exhibits improved lead corrosion properties and no adverse anti-wear properties.

5 Claims, No Drawings

GAS ENGINE LUBRICATING OIL COMPOSITION

FIELD OF THE INVENTION

This invention concerns an improved gas engine lubricating oil composition, in particular, a gas engine lubricating oil composition exhibiting improved lead corrosion performance.

BACKGROUND OF THE INVENTION

Gas engines, which are also called gas-fuelled or gas-fired engines, are used to drive pumping stations of natural-gas pipelines, blowers and generators in, for example, purification plants and on gas tankers. Gas engines may be two- or four-stroke, spark-ignited or compression-ignited. Gas Otto engines ignite a mixture of gas and air using spark plugs. Gas diesel engines use a continuous injection of a small amount, such as, for example, 5-10%, of diesel fuel.

Gas engines operate at high temperatures such as greater than 200° C. in a piston environment. These high temperatures cause oxidation of the gas engine lubricating oil composition, which produces undesirable acids. These acids cause corrosion of the gas engine, in particular, corrosion of bearings in crankshaft journals and crankpins.

Gas engine oils are formulated to minimise engine wear, particularly wear resulting from such acid corrosion.

EP-A-1 347 034 ("'034") describes gas engine lubricating oil compositions having a boron content of at least 95 ppm and comprising at least one metal salicylate having a TBN of 60 to 140. Compositions exemplified in '034 have a low sulphated ash content (not more than 0.6 mass %), include borated dispersant and alkylated dispersant and alkylated diphenylamine anti-oxidant components, and have a boron content of 105 ppm. It is however found that compositions such as those of '034 exhibit adverse lead corrosion properties.

SUMMARY OF THE INVENTION

The invention meets the above problem by providing, as evidenced in the examples of this specification, a gas engine oil lubricating oil composition that has zero or low boron content. It is further found that use of zero or low boron compositions does not give rise to debits in anti-wear performance compared with higher boron compositions.

Thus, in a first aspect, this invention provides a gas engine lubricating oil composition having TBN on the range of 4 to 20 and an ash content in the range of 0.2 to 1 mass % as determined by ASTM D874, comprising or made by admixing (A) an oil of lubricating viscosity including at least 90 mass % of saturates and no more than 0.03 mass % of sulfur in a major amount; and in respective minor amounts, (B) a calcium hydroxybenzoate detergent additive, (C) a dispersant additive; and (D) an aminic or phenolic antioxidant, the composition containing no boron or having a boron concentration of less than 90, such as less than 70, ppm by mass.

In a second aspect, the invention provides a method of lubricating a gas engine comprising the step of operating the engine while lubricating it with the gas engine lubricating oil composition of the first aspect of the invention.

In a third aspect, the invention provides the use of a boron content of zero or less than 90 ppm by mass in combination with a metal hydroxybenzoate detergent, in a minor amount, in a gas engine lubricating oil composition that has a major amount of an oil of lubricating viscosity including at least 90 mass % saturates and no more than 0.03 mass % sulfur, to improve the lead corrosion performance of the composition without adverse effect on its anti-wear performance, in comparison with use of a higher boron-content composition.

In this specification, the following words and expressions, if and when used, have the meanings ascribed below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies;

"hydrocarbyl" means a chemical group of a compound that contains only hydrogen and carbon atoms (and, optionally, additional hetero atoms that do not alter the essential hydrocarbon nature of the group) and that is bonded to the remainder of the compound directly via a carbon atom.

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"major amount" means in excess of 50, preferably in excess of 60, more preferably in excess of 70, and most preferably in excess of 80, mass % of a composition;

"minor amount" means 50 mass % or less, preferably 40 mass % or less, more preferably 30 mass % or less, and most preferably 20 mass % or less, of a composition;

"TBN" means total base number as measured by ASTM D2896;

"phosphorus content" is measured by ASTM D5185;

"sulfur content" is measured by ASTM D2622; and

"sulfated ash content" is measured by ASTM D874.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to each and all aspects of the invention, will now be described in more detail as follows:

Gas Engine Lubricating Oil Composition

The composition has a TBN in the range of 4 to 20, preferably 5 to 15.

It preferably has a sulfated ash content, determined by ASTM D874, of below 0.6, preferably 0.2 to 0.5, mass %.

The boron concentration, determined by ASTM D5185-13, is preferably substantially zero or in the range of 10 to 60, preferably 20 to 50, ppm by mass. ASTM D5185-13 was approved Sep. 15, 2013 and published September 2013. It was originally approved in 1991. It is a standard test method for multi-element determination of used and unused lubricating oils and base oils by inductively coupled plasma atomic emission spectrometry (ICP-AES). By comparing emission intensities of elements in a test specimen with emission intensities measured with standards, the concentrations of elements, including boron, in the test specimen are calculable.

(A) Oil of Lubricating Viscosity

The lubricating oil may have a viscosity index of 80 to 120, determined using ASTM D2270.

The lubricating oil must include at least 90 mass percent of saturates, determined using ASTM D2007.

The lubricating oil must include no more than 0.03 mass percent of sulphur, determined using ASTM's D2622, D4294, D4927 or D3120.

The lubricating oil generally comprises greater than 60, typically greater than 70, more preferably greater than 80 wt % of the lubricating oil composition.

The lubricating oil is preferably a Group II base oil or a Group III-IV base oil, categorised according to the API EOLCS 1509 definition.

Hydrocracked oils, where the refining process further breaks down the middle and heavy distillate fractions in the presence of hydrogen at high temperatures and moderate pressures, are also suitable. Hydrocracked oils typically have a viscosity index typically in the range of from 100 to 110, for example from 105 to 108.

The oil may include 'brightstock' which refers to base oils that are solvent-extracted, de-asphalted products from vacuum residuum generally having a kinematic viscosity at 100° C. of from 28 to 36 $mm^2s^{-1}$ and are typically used in a proportion of less than 30, preferably less than 20, more preferably less than 15, most preferably less than 10, such as less than 5, wt %, based on the weight of the composition.

(B) Metal Hydroxybenzoate Detergent

A detergent is an additive that reduces formation of piston deposits, for example high-temperature varnish and lacquer deposits, in engines; it has acid-neutralising properties and is capable of keeping finely-divided solids in suspension. It is based on metal "soaps", that is metal salts of acidic organic compounds, sometimes referred to as surfactants.

The detergent comprises a polar head with a long hydrophobic tail. The polar head comprises a metal salt of a surfactant. Large amounts of a metal base are included by reacting an excess of a metal compound, such as an oxide or hydroxide, with an acidic gas such as carbon dioxide to give an overbased detergent which comprises neutralised detergent as the outer layer of a metal base (e.g. carbonate) micelle.

The metal may be an alkali or alkaline earth metal such as, for example, sodium, potassium, lithium, calcium, barium and magnesium. Calcium is preferred.

Metal salicylate is the preferred metal salt.

The detergent may be a complex/hybrid detergent prepared from a mixture of more than one metal surfactant, one at least being hydroxybenzoate. Surfactants for the surfactant system of the metal detergents contain at least one hydrocarbyl group, for example, as a substituent on an aromatic ring. Advantageously, hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impact the desired oil-solubility. Advantageously the alkyl groups include from 5 to 100, preferably from 9 to 30, more preferably 14 to 20 or 20 to 28, carbon atoms. Where there is more than one alkyl group, the average number of carbon atoms in all of the alkyl groups is preferably at least 9 to ensure adequate oil-solubility.

The detergents may be non-sulfurized or sulfurized, and may be chemically modified and/or contain additional substitutents. Suitable sulfurizing processes are well known to those skilled in the art.

The detergents may be borated, using borating processes well known to those skilled in the art.

The detergents preferably have a TBN of 20 to 400, preferably 40 to 300, more preferably 40 to 280, even more preferably 40 to 150, even more preferably 50 to 140, and most preferably 60 to 130. Basicity Index (BI) may be used to express the basicity of the detergents. BI is the molar ratio of total base to total soap in an overbased detergents.

The detergents may be used in a proportion providing Ca, expressed as atoms of Ca, in the range of 0.05 to 2, preferably 0.08 to 0.16, mass % based on the mass of the lubricating oil composition.

(C) Dispersant

At least one dispersant is present in the gas engine lubricating oil composition. A dispersant is an additive for a lubricating composition whose primary function is to hold solid and liquid contaminants in suspension, thereby passivating them and reducing engine deposits at the same time as reducing sludge depositions. Thus, for example, a dispersant maintains in suspension oil-insoluble substances that result from oxidation during use of the lubricating oil, thus preventing sludge flocculation and precipitation or deposition on metal parts of the engine.

A noteworthy class of dispersants is "ashless" dispersants, meaning a non-metallic organic material that forms substantially no ash on combustion, in contrast to metal-containing, hence ash-forming, materials. Ashless dispersants comprise a long chain hydrocarbon with a polar head, the polarity being derived from inclusion of, e.g. an O, P or N atom. The hydrocarbon is an oleophilic group that confers oil-solubility, having for example 40 to 500 carbon atoms. Thus, ashless dispersants may comprise an oil-soluble polymeric hydrocarbon backbone having functional groups that are capable of associating with particles to be dispersed.

When the composition of the invention is B-containing, all of the B content may be provided by the dispersant in the form of a boron-containing dispersant.

Examples of ashless dispersants are succinimides, e.g. polyisobutene succinic anhydride: polyamine condensation products that may be borated or unborated.

The dispersant, when N-containing, may be present in an amount providing N, expressed as atoms of N, ranging from 0.1 to 1, preferably from 0.2 to 0.8, mass %, based on the mass of the lubricating oil composition.

(D) Aminic or Phenolic Antioxidant

Examples of aminic antioxidants include secondary aromatic amines such as diarylamines, for example diphenylamines wherein each phenyl group is alkyl-substituted with an alkyl group having 4 to 9 carbon atoms. Examples of phenolic antioxidants include hindered phenols, including mono-phenols and bis-phenols. The anti-oxidant may be present in an amount of up to 3, such as 0.1 to 3, mass % based on the mass of the lubricating oil composition.

Other Co-Additives

These may be present and may include, such as in the concentrations exemplified in parentheses: anti-wear additives (e.g. 0.05 to 1.5 mass %); pour point depressants (e.g. 0.05 to 0.6 mass %); anti-foamants (e.g. 0.001 to 0.2 mass %); and viscosity index improvers (e.g. 0.1 to 3.0 mass %). It may be desirable to prepare an additive package or concentrate of the gas engine lubricating oil composition. The additive package may be added simultaneously to the base oil to form the gas engine lubricating oil composition. Dissolution of the additive package into the lubricating oil may be facilitated by solvents and by mixing accompanied with mild heating. The additive package may typically be formulated to contain the detergent in proper amounts to provide the desired concentration, and/or to carry out the intended function in the final formulation when the additive package is combined with a predetermined amount of base lubricant. The additive package may contain active ingredients in an amount, based on the additive package, of, for example, from 2.5 to 90, preferably from 5 to 75, most preferably from 8 to 60, wt % of additives in the appropriate proportions, the remainder being base oil.

The final formulations may typically contain about 5 to 40 wt %, preferably 5 to 12 wt %, of the additive package, the remainder being base oil.

EXAMPLES

The present invention is illustrated by, but in no way limited to, the following examples.

Gas engine lubricating oil compositions, identified in Table 1 below, were prepared by blending the indicated components.

TABLE 1

| Components | Example A | Example B | Example 1 | Example C | Example 2 |
|---|---|---|---|---|---|
| Dispersant (950 MW unborated) | | | 0.03 | | |
| Dispersant (950 MW overborated) | | | | 0.01 | |
| Dispersant (950 MW borated) | 0.06 | 0.06 | 0.03 | | |
| Dispersant (2225 MW unborated) | | | | 0.03 | 0.04 |
| Detergent (BI 3 Ca salicylate) wt % Ca | 0.12 | 0.12 | 0.12 | 0.13 | 0.13 |
| Anti-wear additive, wt % P | 0.03 | 0.03 | 0.03 | 0.03 | 0.03 |
| Anti-oxidant, wt % N | 0.02 | 0.02 | 0.02 | 0.02 | 0.02 |
| Others | 0.08 | 0.08 | 0.09 | 0.08 | 0.09 |
| Lubricating Oil (Group II) | Balance | Balance | Balance | Balance | Balance |
| ppm B | 136 | 136 | 68 | 100 | 0 |
| Ash | 0.46 | 0.46 | 0.45 | 0.50 | 0.49 |
| TBN | 5.5 | 5.5 | 5.5 | 5.4 | 5.4 |

All values are mass % unless otherwise indicated or apparent. Examples A-C are comparative examples, and Examples 1-2 are examples of the invention.

Tests

Each composition was subjected to a lead corrosion test, namely the spiked High Temperature Corrosion Bench Test (HTCBT) reported in CIMAC 2010. The results are shown in Table 2 below.

TABLE 2

| Example | Boron Content (ppm) | Pb ppm (spiked) |
|---|---|---|
| A | 136 | 309 |
| B | 136 | 382 |
| 1 | 68 | 0 |
| C | 100 | 230 |
| 2 | 0 | 0 |

Lower values of Pb indicate better results. The best results are achieved by examples of the invention, i.e. Examples 1 and 2.

Each composition was also subjected to a wear test, the High Frequency Reciprocating Rig (HFRR) test, as follows.

Samples of the above formulations were tested using a PCS Instruments high frequency reciprocating rig (HFRR) on a standard protocol comprising the following conditions:

15 minutes

20 Hz reciprocation of 1 mm stroke length 400 g load using standard equipment manufacturer-supplied steel substrates 80° C. to 380° C. at 20° C. per minute The wear scar measurements reported were taken of the wear scars on the HFRR discs. The instrument used for these measurements was a Zemetrics ZeScope 3D optical profilometer. The measurements reported are the void volumes of the wear scars on the HFRR discs. Each test was repeated two further times and the recorded wear measurement was the average of these values.

The results are shown in Table 3 below.

TABLE 3

| Example | Boron content (ppm) | Wear scar (μm) |
|---|---|---|
| A | 136 | 292 |
| B | 136 | 268 |
| 1 | 68 | 263 |
| C | 100 | 320 |
| 2 | 0 | 269 |

Lower values of wear scar indicate better results. Results for Examples 1-2 (invention) are broadly comparable to those of Examples A-C (comparison) indicating that use of lower or zero boron levels does not give rise to a wear performance debit.

What is claimed is:

1. A gas engine lubricating oil composition having TBN in the range of 4 to 20 mg KOH/g and an ash content of 0.2 to 0.6 mass %, as determined by ASTM D874, comprising, or made by admixing:

(A) an oil of lubricating viscosity including at least 90 mass % of saturates and no more than 0.03 mass % of sulfur in a major amount; and in respective minor amounts:

(B) a calcium salicylate detergent additive in an amount providing the lubricating oil composition with 0.08 to 0.16 mass % of calcium, expressed as atoms of Ca;

(C) succinimide dispersant additive in an amount providing the lubricating oil composition with 0.2 to 0.8 mass % of nitrogen; and (D) 0.1 to 3 mass % of an aminic or phenolic antioxidant, the composition having a boron concentration of from 10 ppm to less than 90 ppm by mass; wherein said boron is provided at least in part by a boron-containing dispersant additive (C).

2. The composition of claim 1 wherein the boron concentration is in the range of 10 to 60 ppm by mass.

3. The composition of claim 1, wherein all the boron is provided by a boron-containing dispersant additive (C).

4. The composition of claim 1, further including, as co-additives (in addition to (B), (C) and (D)), in respective minor amounts, one or more dispersants, detergents, anti-wear additives, anti-oxidants, and corrosion inhibitors.

5. A method of lubricating a gas engine comprising the step of operating the engine while lubricating said engine with the gas engine lubricating oil composition of claim 1.

* * * * *